US007034675B2

(12) United States Patent
DiPoala et al.

(10) Patent No.: US 7,034,675 B2
(45) Date of Patent: Apr. 25, 2006

(54) INTRUSION DETECTION SYSTEM INCLUDING OVER-UNDER PASSIVE INFRARED OPTICS AND A MICROWAVE TRANSCEIVER

(75) Inventors: William S DiPoala, Fairport, NY (US); Michael J Bernard, Farmington, NY (US)

(73) Assignee: Robert Bosch GmbH, Stuttgart (DE)

( * ) Notice: Subject to any disclaimer, the term of this patent is extended or adjusted under 35 U.S.C. 154(b) by 106 days.

(21) Appl. No.: 10/825,909

(22) Filed: Apr. 16, 2004

(65) Prior Publication Data

US 2005/0231353 A1 Oct. 20, 2005

(51) Int. Cl.
*G08B 19/00* (2006.01)

(52) U.S. Cl. ..... 340/522; 340/511; 340/552; 340/567; 307/117; 250/DIG. 1

(58) Field of Classification Search ..... 340/522, 340/511, 552, 567, 541, 506, 507, 565, 554, 340/501, 521; 307/116, 117; 250/DIG. 1, 250/353

See application file for complete search history.

(56) References Cited

U.S. PATENT DOCUMENTS 4,710,750 A 12/1987 Johnson
4,882,567 A * 11/1989 Johnson ..... 340/522
5,331,308 A * 7/1994 Buccola et al. ..... 340/522
5,461,231 A 10/1995 Sugimoto et al.
5,473,311 A 12/1995 Hoseit
5,491,467 A 2/1996 Tracy et al.
5,670,943 A 9/1997 DiPoala et al.
5,923,250 A 7/1999 Pildner et al.
6,078,253 A * 6/2000 Fowler ..... 340/501
6,157,299 A * 12/2000 Wang ..... 340/506
6,188,318 B1 2/2001 Katz et al.
6,211,522 B1 4/2001 Kotlicki et al.
6,215,399 B1 4/2001 Shpater
6,262,661 B1 * 7/2001 Mahler et al. ..... 340/567
6,265,972 B1 7/2001 Lee
6,384,414 B1 5/2002 Fisher et al.
6,559,448 B1 5/2003 Müller et al.

* cited by examiner

*Primary Examiner*—Anh V. La
(74) *Attorney, Agent, or Firm*—Baker & Daniels LLP

(57) ABSTRACT

An intrusion detection system includes a microwave transceiver detecting motion in a protected space. The microwave transceiver generates a first signal. A first infrared sensor detects a source of infrared energy in a plurality of upper detection zones within the protected space. The first infrared sensor generates an upper sensor signal. A second infrared sensor detects a source of infrared energy in a plurality of lower detection zones positioned below the upper detection zones within the protected space and intersecting a floor surface within the protected space. The second infrared sensor generates a lower sensor signal. A processor receives the first signal, the upper sensor signal and the lower sensor signal. The processor generates an alarm signal in response to the first signal exceeding a threshold value. The threshold value is varied in response a relationship between the lower sensor signal and the upper sensor signal.

25 Claims, 5 Drawing Sheets threshold voltage
amplitude ratio
$V_{TH}$
$V_{TH}$ short
$V_{TH}$ medium
$V_{TH}$ long
0
5
17
23
40
distance (feet)
1
0
Amplitude of $V_L$ (t) / Amplitude of $V_H$ (t)

INTRUSION DETECTION SYSTEM INCLUDING OVER-UNDER PASSIVE INFRARED OPTICS AND A MICROWAVE TRANSCEIVER

BACKGROUND OF THE INVENTION

1. Field of the Invention

The present invention relates to surveillance systems, and, more particularly, to surveillance systems for detecting an intruder in a monitored area of space.

2. Description of the Related Art

Surveillance systems for detecting intrusions of a moving object, such as a human, into a monitored area of space are known. The motion detectors often include infrared detectors that sense the presence of a source of infrared radiation, e.g., a warm body, anywhere along the line of sight of the infrared sensors.

A problem with infrared detectors is that they cannot easily distinguish between a human intruder and a house pet, such as a dog or a cat. It is particularly difficult for an infrared detector to distinguish between a pet at close range to the detector and a human located further away from the detector. An undesirable consequence of this problem is that an infrared detector may falsely set off an alarm in response to detecting a pet.

The detectors may also include microwave-based Doppler detectors that sense movement of objects by transmitting microwave energy and receiving the microwave energy after it has been reflected off of the objects. One problem with microwave-based Doppler detectors is that, similarly to infrared detectors, they sometimes cannot easily distinguish between a human intruder and a house pet. A small object close to the detector may produce the same signals as a larger object that is farther away from the detector. Thus, a dog that is fifteen feet from the detector may produce a signal similar to that of a human who is thirty feet from the detector. Like infrared detectors, microwave-based Doppler detectors may falsely set off an alarm in response to detecting a pet.

Another problem with microwave-based Doppler detectors is that they cannot easily distinguish between a human intruder and other inanimate objects that may have some movement, such as balloons, hanging signs, or curtains, all of which may be moved to some degree by air currents. Thus, a microwave-based Doppler detector may issue a false alarm as a result of detecting the movement of an inanimate object.

While various methods of reducing false alarms in intrusion detection systems have been developed there remains a need in the art to provide an intrusion detection system that can easily distinguish human intruders from both house pets, or other small animals, and moving inanimate objects, and that is thus less susceptible to issuing false alarms as a result of detecting house pets or moving inanimate objects.

SUMMARY OF THE INVENTION

The present invention provides an intrusion detection system that includes two infrared detectors as well as a microwave-based detector. One of the infrared detectors detects a source of infrared energy in lower detection zones that intersect a floor surface. The other of the infrared detectors detects a source of infrared energy in upper detection zones disposed above the lower detection zones. The relative strengths of the signals from the two infrared detectors can provide information indicative of the distance of the source of infrared energy from the infrared detectors and the size of the source. Thus, the relative strengths of the signals from the two infrared detectors can be used to set a threshold value that a characteristic of the signal from the microwave-based detector must exceed before an alarm signal can be generated.

The invention comprises, in one form thereof, an intrusion detection system including a microwave transceiver detecting motion in a protected space. The microwave transceiver generates a first signal. A first infrared sensor detects a source of infrared energy in a plurality of upper detection zones within the protected space. The first infrared sensor generates an upper sensor signal. A second infrared sensor detects a source of infrared energy in a plurality of lower detection zones positioned below the upper detection zones within the protected space and intersecting a floor surface within the protected space. The second infrared sensor generates a lower sensor signal. A processor receives the first signal, the upper sensor signal and the lower sensor signal. The processor generates an alarm signal in response to the first signal exceeding a threshold value. The threshold value is varied in response a relationship between the lower sensor signal and the upper sensor signal.

The invention comprises, in another form thereof, an intrusion detection system including a microwave transceiver detecting motion in a protected space. The microwave transceiver generates a first signal. A first infrared sensor detects a source of infrared energy in a plurality of upper detection zones within the protected space. The first infrared sensor generates an upper sensor signal. A second infrared sensor detects a source of infrared energy in a plurality of lower detection zones positioned below the upper detection zones within the protected space. The second infrared sensor generates a lower sensor signal. A processor receives the first signal, the upper sensor signal and the lower sensor signal. The processor generates an alarm signal in response to the first signal crossing a threshold value a required number of times within a time period. The required number and/or the time period are varied in response to a relationship between the lower sensor signal and the upper sensor signal.

The invention comprises, in yet another form thereof, an intrusion detection system including a microwave transceiver detecting motion in a protected space. The microwave transceiver generates a first signal having a characteristic. A first infrared sensor detects a source of infrared energy in a plurality of upper detection zones within the protected space. The first infrared sensor generates an upper sensor signal. A second infrared sensor detects a source of infrared energy in a plurality of lower detection zones positioned below the upper detection zones within the protected space. The second infrared sensor generates a lower sensor signal. A processor receives the first signal, the upper sensor signal and the lower sensor signal. The processor generates an alarm signal in response to the characteristic of the first signal exceeding a threshold value. The threshold value varies in response to a relationship between the lower sensor signal and the upper sensor signal.

The invention comprises, in a further form thereof, an intrusion detection system including a microwave transceiver detecting motion in a protected space and generating a first signal. A first infrared sensor detects a source of infrared energy in a plurality of upper detection zones within the protected space and generates an upper sensor signal. A processor receives the first signal and the upper sensor signal and generates an alarm signal when the first signal exceeds a variable threshold value wherein the variable threshold value has a maximum value when the upper sensor signal indicates the absence of a infrared energy source in the upper detection zones and, when the upper sensor signal indicates the presence of infrared energy source in the upper detection zone, the variable threshold value is decreased as said upper sensor signal decreases.

An advantage of the present invention is that the detection system can more easily distinguish between human intruders and small animals or moving inanimate objects. Thus, a reduced level of false alarms are issued by the detection system.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Figure 1:
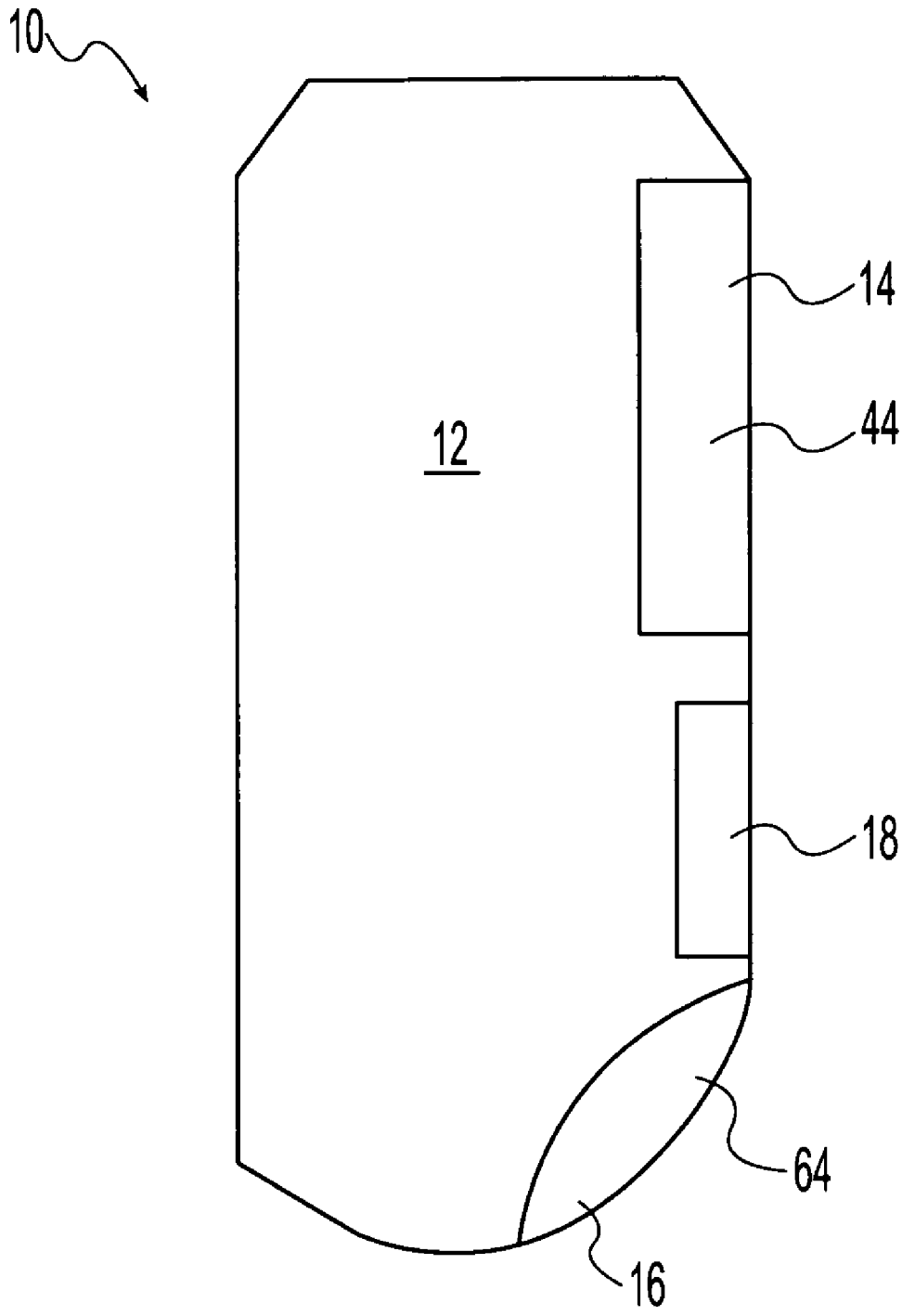
FIG. 1 is a side view of one embodiment of a detector assembly of the present invention.

Corresponding reference characters indicate corresponding parts throughout the several views. Although the exemplification set out herein illustrates embodiments of the invention, in several forms, the embodiments disclosed below are not intended to be exhaustive or to be construed as limiting the scope of the invention to the precise forms disclosed.

DESCRIPTION OF THE PRESENT INVENTION

Figure 2A:
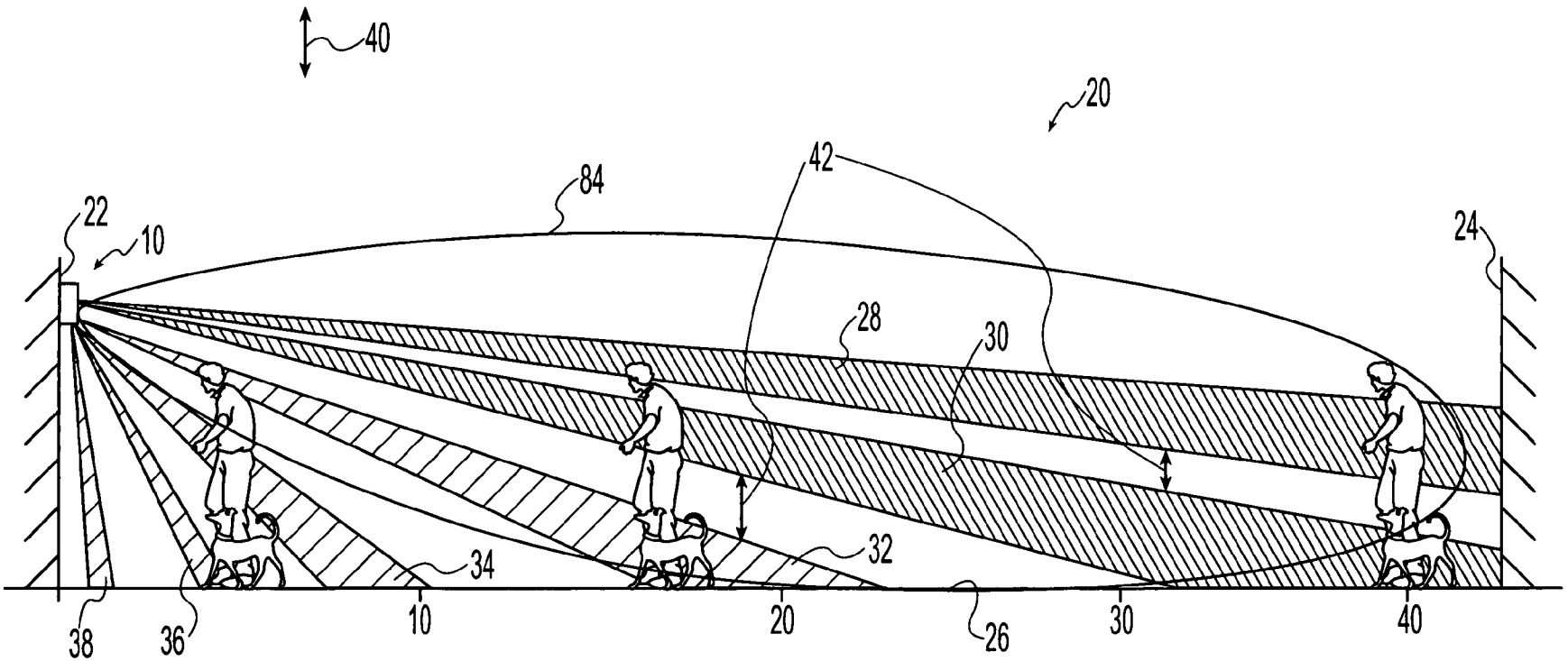
FIG. 2*a* is a side view of the detector assembly of FIG. 1 and associated infrared detection zones and microwave detection area within a protected space that is monitored by the detector assembly.

Referring now to the drawings and particularly to FIG. 1, there is shown one embodiment of a sensor assembly 10 of the present invention including a housing 12 containing an upper passive infrared (PIR) sensor 14, a lower passive infrared (PIR) sensor 16, and a microwave transceiver 18. As shown in FIG. 2*a*, assembly 10 monitors a three-dimensional protected space 20 defined by opposite walls 22, 24 and a floor 26. Housing 12 is mounted on wall 22 in a location that is approximately between 6 feet (1.83 m) and 7 feet (2.13 m) above floor 26.

Upper PIR sensor 14 detects sources of infrared energy that are disposed at least partially within upper detection zones 28, 30. Detection zone 28 extends from assembly 10 and intersects wall 24. Detection zone 30 is directed at a more downward angle than zone 28 and intersects floor 26 as well as a portion of wall 24. Lower PIR sensor 16 detects sources of infrared energy that are disposed at least partially within lower detection zones 32, 34, 36 and 38. Detection zones 32, 34, 36 and 38 all extend from assembly 10 at a more downwardly directed angle than upper detection zones 28, 30 and intersect floor 26 at locations closer to assembly 10 than the location at which detection zone 30 intersects floor 26.

Detection zones 28, 30, 32, 34, 36 and 38 are dispersed both vertically in directions indicated by double arrow 40 and horizontally in directions into and out of the page of FIG. 2*a*. Any vertically adjacent pair of detection zones 28, 30, 32, 34, 36 and 38 has a vertical gap 42 therebetween. In one embodiment, gaps 42 all have maximum heights of less than about 3.5 feet (1.07 m). In another embodiment, gaps 42 all have maximum heights of less than about 2.5 feet (0.76 m). It is possible for the gap 42 between detection zones 30 and 32 to be larger than the other gaps 42 in order to ensure that there is no overlap between detection zones 30 and 32, and thus to ensure that upper PIR sensor 14 and lower PIR sensor 16 do not monitor overlapping portions of space.

Horizontal gaps between horizontally adjacent detection zones may be sized such that a human could not be entirely disposed between horizontally adjacent detection zones. In one embodiment, horizontal gaps between horizontally adjacent detection zones have maximum widths of about one foot or less. In another embodiment, vertically adjacent layers of detections zones are horizontally staggered such that a cross section of the three-dimensional array of detection zones forms a tessellated or checkerboard-like pattern. Thus, detection zones 28, 30, 32, 34, 36 and 38 form a three-dimensional array such that substantially any human adult or adolescent within protected space 20 is disposed in at least one of the detection zones.

Figure 3:
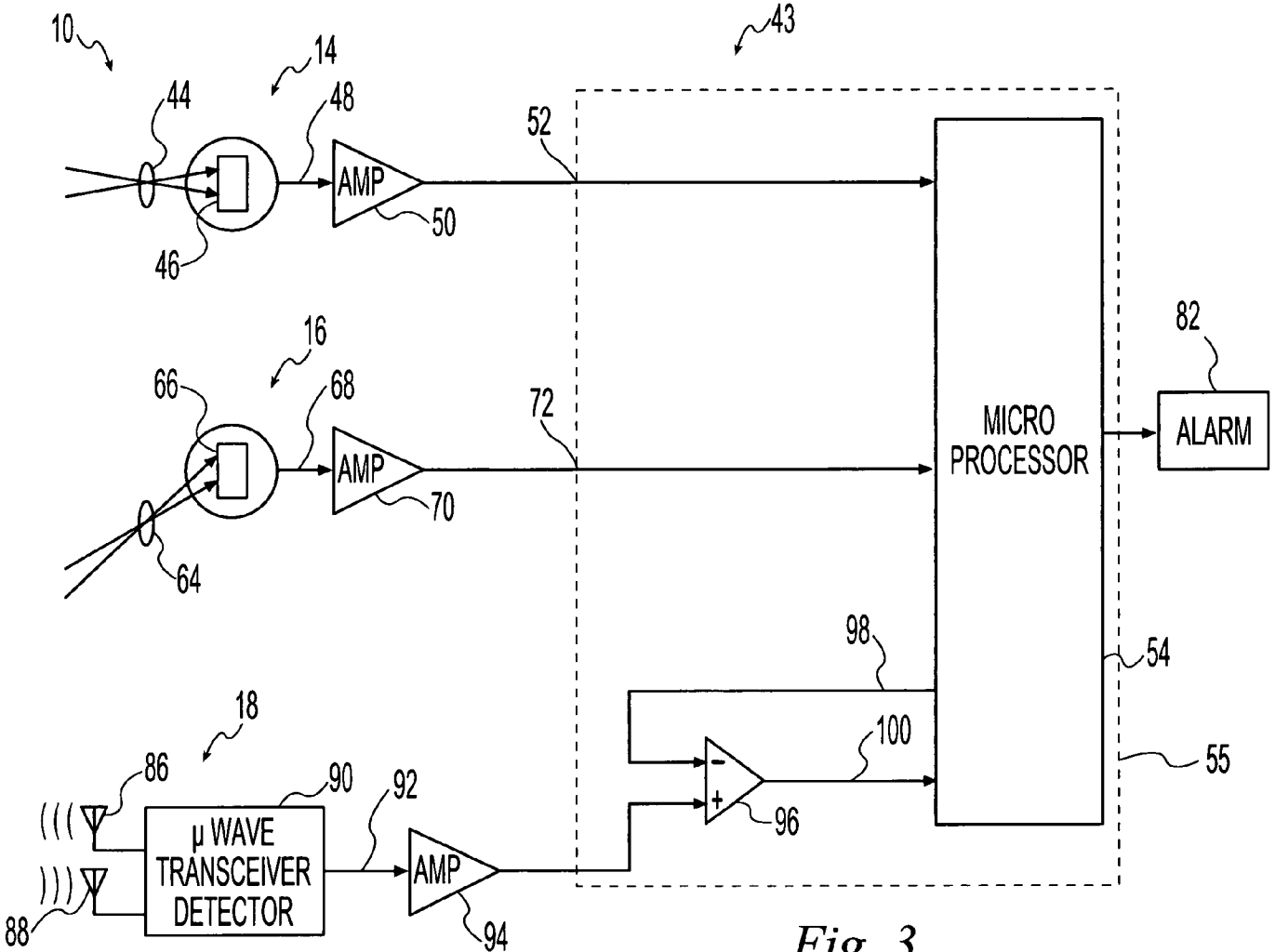
FIG. 3 is a schematic block diagram of one embodiment of an intrusion detection system of the present invention including the detector assembly of FIG. 1.

FIG. 3 illustrates one embodiment of an intrusion detection system 43 of the present invention in communication with an alarm 82. Intrusion detection system 43 includes detector assembly 10, amplifiers 50, 70, 94, 96 and a microcontroller 55 that includes a microprocessor 54. As shown in FIG. 3, upper PIR sensor 14 includes a lens, such as a fresnel lens 44, for focusing infrared energy from detection zones 28, 30 onto sensing surface 46 of sensor 14. In another embodiment, lens 44 is replaced by a focusing mirror. The use of fresnel lens and focusing mirrors with PIR sensors to define vertically and horizontally discrete detection zones is well known to those having ordinary skill in the art.

When a source of infrared energy is disposed in detection zones 28, 30, PIR sensor 14 generates an upper sensor signal 48. Upper sensor signal 48 is suitably amplified by high gain bandpass amplifier 50, which filters out frequencies uncharacteristic of intrusion and transmits the amplified upper sensor signals to an input 52 of microcontroller 55. Before or after being received at input 52, the amplified output may be converted to a digital signal suitable for processing by microprocessor 54.

Figures 2B, 2C, 2D, 2E, 2F, 2G, 2H, 2I, 2J, 2K, 2L, 2M:
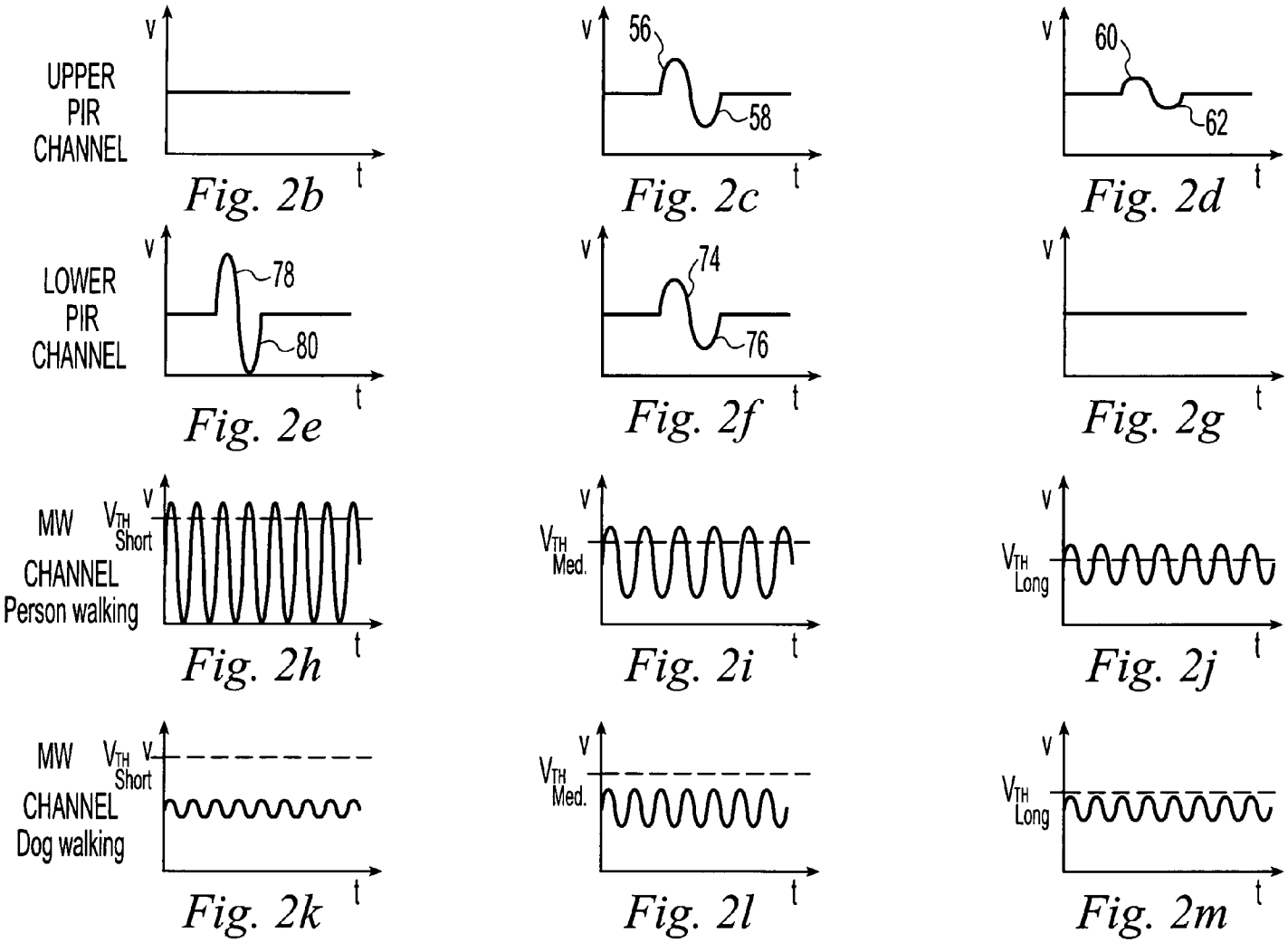
FIG. 2*b* is a plot of the voltage signal from the upper infrared detector of the detector assembly of FIG. 1 versus time as a result of a human walking within the protected space at a distance of approximately five feet from the detector assembly.
FIG. 2*c* is a plot of the voltage signal from the upper infrared detector of the detector assembly of FIG. 1 versus time as a result of a human walking within the protected space at a distance of approximately seventeen feet from the detector assembly.
FIG. 2*d* is a plot of the voltage signal from the upper infrared detector of the detector assembly of FIG. 1 versus time as a result of a human walking within the protected space at a distance of approximately 40 feet (12.19 m) from the detector assembly.
FIG. 2*e* is a plot of the voltage signal from the lower infrared detector of the detector assembly of FIG. 1 versus time as a result of a human walking within the protected space at a distance of approximately 5 feet (1.52 m) from the detector assembly.
FIG. 2*f* is a plot of the voltage signal from the lower infrared detector of the detector assembly of FIG. 1 versus time as a result of a human walking within the protected space at a distance of approximately 17 feet (5.18 m) from the detector assembly.
FIG. 2*g* is a plot of the voltage signal from the lower infrared detector of the detector assembly of FIG. 1 versus time as a result of a human walking within the protected space at a distance of approximately 40 feet from the detector assembly.
FIG. 2*h* is a plot of the voltage signal from the microwave transceiver of the detector assembly of FIG. 1 versus time as a result of a human walking within the protected space at a distance of approximately 5 feet from the detector assembly.
FIG. 2*i* is a plot of the voltage signal from the microwave transceiver of the detector assembly of FIG. 1 versus time as a result of a human walking within the protected space at a distance of approximately 17 feet from the detector assembly.
FIG. 2*j* is a plot of the voltage signal from the microwave transceiver of the detector assembly of FIG. 1 versus time as a result of a human walking within the protected space at a distance of approximately 40 feet from the detector assembly.
FIG. 2*k* is a plot of the voltage signal from the microwave transceiver of the detector assembly of FIG. 1 versus time as a result of a dog walking within the protected space at a distance of approximately 5 feet from the detector assembly.
FIG. 2*l* is a plot of the voltage signal from the microwave transceiver of the detector assembly of FIG. 1 versus time as a result of a dog walking within the protected space at a distance of approximately 17 feet from the detector assembly.
FIG. 2*m* is a plot of the voltage signal from the microwave transceiver of the detector assembly of FIG. 1 versus time as a result of a dog walking within the protected space at a distance of approximately 40 feet from the detector assembly.

FIGS. 2*b*, 2*c* and 2*d* are plots of the amplified upper sensor signal 48 when a human stands about 5 feet, 17 feet, and 40 feet, respectively, away from detector assembly 10. At 5 feet away, no part of the human is disposed within detection zones 28, 30, and thus signal 48 has a constant voltage level, as shown in FIG. 2*b*. At 17 feet away, the human is partially disposed within at least one of detection zones 28, 30, and signal 48 includes a first pulse 56 in one direction followed by a second pulse 58 in an opposite direction, as shown in FIG. 2*c*. At 40 feet away, the human is again partially disposed within at least one of detection zones 28, 30, and signal 48 again includes a first pulse 60 in one direction followed by a second pulse 62 in an opposite direction, as shown in FIG. 2*d*. Due to the increased distance between the human and PIR sensor 14, the amplitudes, i.e., maximum absolute values, of pulses 60, 62 are less than those of corresponding pulses 56, 58.

Lower PIR sensor 16 includes a lens, such as a fresnel lens 64, for focusing infrared energy from detection zones 32, 34, 36 and 38 onto sensing surface 66 of sensor 16. Lens 64 has a relatively short focal length for short range detection and is configured to define detection zones 32, 34, 36 and 38, while lens 44 has a relatively long focal length for long range detection and is configured to define detection zones 28, 30. As shown in FIG. 1, lens 64 can be at least partially disposed on a bottom end of housing 12, and is angled in a generally downward direction in order to improve the catch performance beneath housing 12. In one embodiment, the efficiency with which lens 44 focuses infrared energy from protected space 20 on surface 46 and the efficiency with which lens 64 focuses infrared energy from protected space 20 on surface 66 are substantially equivalent. For example, lenses 44 and 64 may have effective apertures that are of the same size or that have equivalent effective f-numbers. Lens 64 may also be replaced by a focusing mirror.

When a source of infrared energy is disposed in detection zones 32, 34, 36 and 38, PIR sensor 16 generates a lower sensor signal 68. Lower sensor signal 68 is suitably amplified by high gain bandpass amplifier 70, which filters out frequencies uncharacteristic of intrusion and transmits the amplified lower sensor signals to an input 72 of microcontroller 55. Before or after being received at input 72, the amplified output may be converted to a digital signal suitable for processing by microprocessor 54.

FIGS. 2*e*, 2*f* and 2*g* are plots of the amplified lower sensor signal 68 when a human stands about 5 feet, 17 feet, and 40 feet, respectively, away from detector assembly 10. At 40 feet away, no part of the human is disposed within detection zones 32, 34, 36 and 38, and thus signal 68 has a constant voltage level, as shown in FIG. 2*g*. At 17 feet away, the human is partially disposed within detection zone 32, and signal 68 includes a first pulse 74 in one direction followed by a second pulse 76 in an opposite direction, as shown in FIG. 2*f*. At 5 feet away, the human is partially disposed within at least one of detection zones 32, 34, 36, and signal 68 again includes a first pulse 78 in one direction followed by a second pulse 80 in an opposite direction, as shown in FIG. 2*e*. Due to the increased distance between the human and PIR sensor 16, the amplitudes of pulses 74, 76 are less than those of corresponding pulses 78, 80.

Microprocessor 54 is able to distinguish upper sensor signal 48 from lower sensor signal 68 by virtue of receiving the amplified upper sensor signal 48 and the amplified lower sensor signal 68 via separate respective inputs 52, 72 to microcontroller 55. As can be readily seen by comparing the upper sensor signal to the lower sensor signal in each of the three cases, i.e., human at 5, 17 or 40 feet, there is a relationship between the upper and lower sensor signals that varies with the distance of the human from housing 12. More particularly, the ratio of the amplitude of the lower sensor signal to the amplitude of the upper sensor signal, or vice versa, varies with the distance between the human and housing 12. Thus, microprocessor 54 can extract information about the distance between the human and housing 12 from the ratio of the amplitude of the lower sensor signal to the amplitude of the upper sensor signal. Microprocessor 54 can use this extracted distance information in determining whether to generate an alarm signal that activates an alarm 82, as described in more detail below.

Microwave transceiver 18 is capable of detecting motion of objects generally within a microwave detection space 84 that is at least partially disposed within protected space 20. Microwave transceiver 18 may also detect motion of objects within spaces adjacent to space 84 with more limited effectiveness. In the embodiment shown in FIG. 2*a*, microwave detection space 84 extends about 42 feet (12.80 m) in the forward direction toward wall 24. Microwave detection space 84 may also extend a similar distance, or slightly more, e.g., about 48 feet (14.63 m), in lateral directions into and out of the page of FIG. 2*a*. Protected space 20 may be generally defined as the intersection of microwave detection space 84 and detection zones 28, 30, 32, 34, 36 and 38, i.e., the space wherein an object such as a human intruder may be detected by both microwave transceiver 18 and at least one of PIR sensors 14, 16.

Transceiver 18 includes a transmitting antenna 86, a receiving antenna 88 and a microwave transceiver detector 90. Transmitting antenna 86 transmits microwave energy generally into microwave detection space 84 and protected space 20. As the microwave signals impinge on an object in or around microwave detection space 84, such as a human or a pet, at least a portion of the microwave signals are reflected back toward and received by receiving antenna 88. Dependent upon the magnitude, amplitude, frequency, phase or other aspects of the reflected signal, detector 90 may generate a voltage signal that is indicative of the presence of a moving object within protected space 20. An output signal 92 of detector 90 is suitably amplified by high gain bandpass amplifier 94, which filters out frequencies uncharacteristic of intrusion and transmits the amplified signals to differential amplifier 96. Amplifier 96 provides a threshold sensing function, compared to a reference voltage from output 98 of microprocessor 54, that rejects outputs not indicative of a human intruder. The output of amplifier 96, which is transmitted to an input 100 of microprocessor 54, goes positive whenever the output of amplifier 94 exceeds the reference voltage from output 98. Before being received at input 100, the output of amplifier 96 is converted to a digital signal suitable for processing by microprocessor 54.

In one embodiment, microprocessor 54 and differential amplifier 96 are housed in a central control box (not shown), and amplifiers 50, 70 and 94 are disposed within housing 12. However, it is also possible for microprocessor 54 and differential amplifier 96 to be disposed within housing 12, or for amplifiers 50, 70 and 94 to be housed in the central control box.

FIGS. 2*h*, 2*i* and 2*j* are plots of the output of amplifier 94, i.e., an amplified version of microwave signal 92, when a human is in motion at a location about 5 feet, 17 feet, and 40 feet, respectively, away from detector assembly 10. As is apparent in the plots, both the amplitude and peak-to-peak voltage of the amplified signal vary inversely with the distance of the human from detector assembly 10 and microwave transceiver 18.

FIGS. 2*k*, 2*l* and 2*m* are plots of the amplified microwave signal from amplifier 94 when a small animal or pet, such as a dog or a cat, is in motion at a location about 5 feet, 17 feet, and 40 feet, respectively, away from detector assembly 10. Because a pet is smaller than a human, the amplified signal has a smaller amplitude and peak-to-peak voltage when caused by a pet than when caused by a human. As is the case with a human, both the amplitude and peak-to-peak voltage of the amplified signal vary inversely with the distance of the pet from detector assembly 10 and microwave transceiver 18 in the range approximately between 20 feet (6.10 m) and 40 feet (12.19 m). In the range of approximately between 0 and 20 feet, however, both the amplitude and peak-to-peak voltage of the amplified signal may have a positive relationship, i.e., vary non-inversely, with the distance of the pet from detector assembly 10 and microwave transceiver 18. The reason for this is that a microwave transceiver, such as transceiver 18, does not detect pets well in the range between 0 and 10 feet (3.05 m). As can be seen in FIG. 2*a*, a pet that is between 0 and 10 feet away from wall 22 is generally disposed below and outside of microwave detection space 84.

The relationship between the lower and upper sensor signals that varies with the distance of the human from housing 12 also generally holds true for a pet or other small animal. For example, when a dog is located approximately 5 feet from the sensor, the dog will generate a signal in the lower PIR sensor and no signal in the upper PIR signal. This is similar to the signals for a human represented in FIGS. 2*b* and 2*e*, however, the signal generated by the lower PIR sensor will typically have a smaller amplitude for a dog than for a human. For locations progressively further away from the detector, the dog will continue to generate a signal in only the lower PIR channel until it approaches the point where detection zone 30 is sufficiently close to floor 26 for the dog to be detected by the upper PIR sensor. At this point, it may be possible for the dog to be present in a detection zone of both the upper PIR sensor and the lower PIR sensor, in which case, signals similar to those depicted in FIGS. 2*c* and 2*f*, although typically of a smaller amplitude, will be generated by the upper and lower PIR sensors. For a dog, this detection by both the upper and lower PIR sensor will occur at a distance from the detector that is greater than that for a relatively taller human. Depending upon the height of the dog, or other small animal, the dog may never be present in a detection zone for both the upper and lower PIR sensor. When the dog is present at a location where detection zone 30 intersects floor 26, i.e., a relatively far distance from the detector, the dog will be detected by the upper PIR sensor and not the lower PIR sensor resulting in signals similar to those depicted in FIGS. 2*d* and 2*g* but wherein the signal may have a smaller amplitude.

Thus, in order to better distinguish between a human intruder and a pet when determining whether to activate alarm 82, microprocessor 54 can cause the threshold voltage level on output 98 to vary dependent upon the relationship between the lower and upper sensor signals. More particularly, the threshold voltage $V_{TH}$ can be varied with a ratio of the lower sensor signal 68 $V_L(t)$ to the upper sensor signal 48 $V_H(t)$. As shown in FIGS. 2*h* through 2*m*, the threshold voltage 12 ($V_{TH\ medium}$) for when the $V_L/V_H$ ratio corresponds to a human being 17 feet from housing is set by microprocessor 54 to a higher level than the level to which the threshold voltage is set ($V_{TH\ long}$) when the $V_L/V_H$ ratio corresponds to a human being 40 feet from housing 12. Moreover, the threshold voltage ($V_{TH\ short}$) when the $V_L/V_H$ ratio corresponds to a human being 5 feet from housing 12 is set by microprocessor 54 to a still higher level than the $V_{TH\ medium}$ level. Thus, the threshold value is relatively increased in response to the lower sensor signal indicating the presence of a source of infrared energy and the upper sensor signal indicating the absence of a source of infrared energy. When a human is closer to housing 12, because the amplified version of the microwave signal 92 has greater peak voltages, the threshold voltage can be increased to a level where alarm 82 is activated when appropriate, i.e., when a human is present, yet the number of false alarms due to moving pets is reduced.

For example, as can be seen by a comparison of FIGS. 2*j* and 2*l*, the microwave channel signal generated by a human at approximately 40 feet and a dog at approximately 17 feet from the detector are approximately equivalent. The PIR channel signals generated by the human at 40 feet and the dog at 17 feet will, however, differ. The PIR channel signals generated by the human at 40 feet are represented by the FIGS. 2*d* and 2*g*, i.e., an upper PIR channel signal and no lower PIR channel signal, thus, due to the upper PIR channel signal being greater than the lower PIR channel signal, the threshold voltage is set at $V_{TH\ long}$ and an alarm is generated as depicted in FIG. 2*j*. A dog at 17 feet, however, will generate a lower PIR channel and either no upper PIR channel (resulting in the threshold voltage being set at $V_{TH\ short}$) or one that is no greater than the lower PIR channel (resulting in the threshold voltage being set at $V_{TH\ medium}$). In either case, the microwave channel signal generated by the dog at 17 feet will fall below the threshold values $V_{TH\ short}$, $V_{TH\ medium}$ and no alarm will be generated thereby avoiding the generation of a false alarm.

Figure 4:
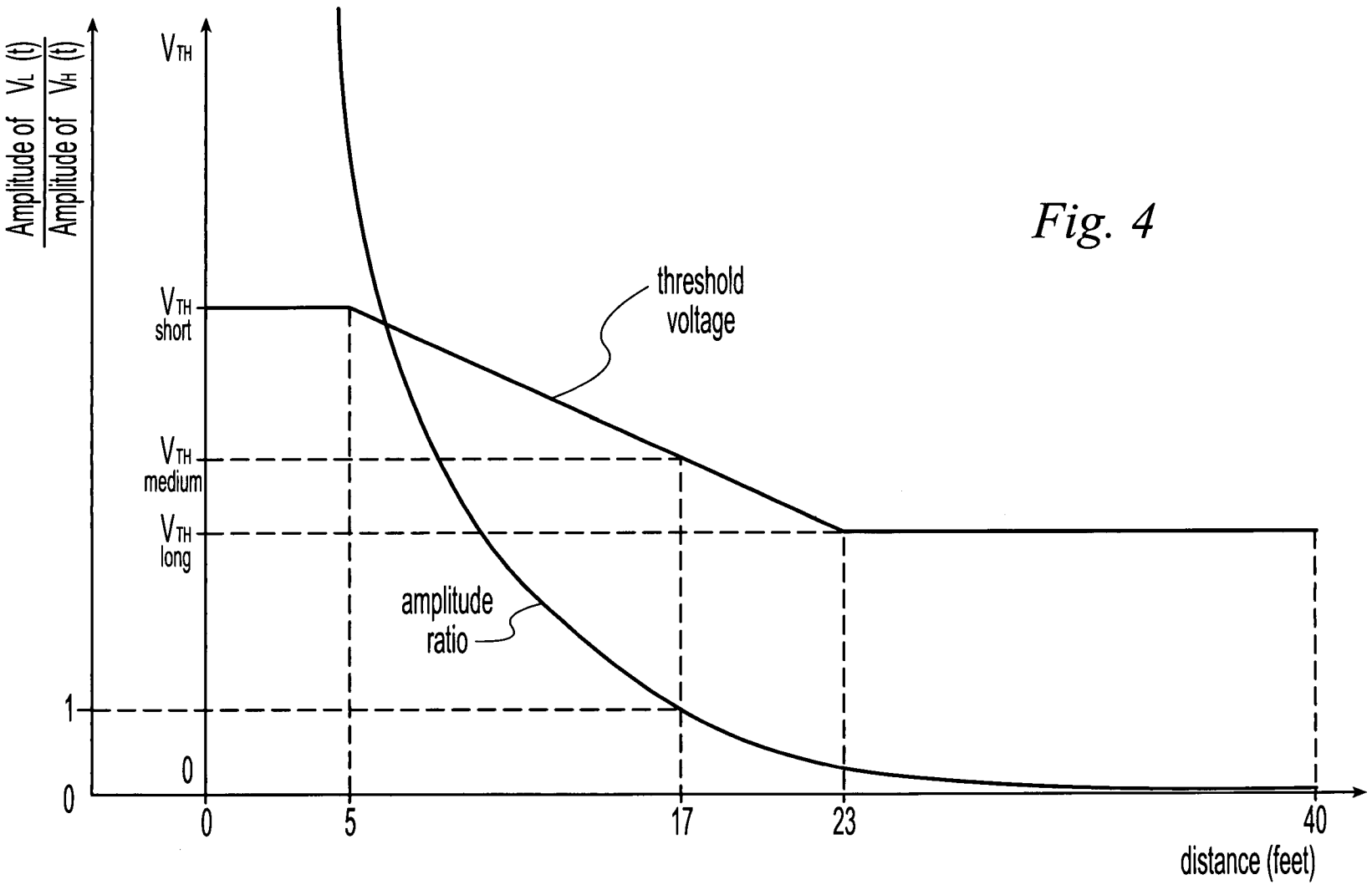
FIG. 4 is a plot of: a) the amplitude of the lower PIR sensor signal divided by the upper PIR sensor signal as a function of the distance between the object and the sensors; and b) the microwave threshold voltage as a function of the distance between the object and the sensors.

FIG. 4 illustrates one embodiment of the relationship between the distance of a human from detector assembly 10 and the ratio of the amplitude of the lower PIR sensor signal to the amplitude of the upper PIR sensor signal. FIG. 4 also illustrates one embodiment of the relationship between the distance of a human from detector assembly 10 and the threshold voltage that is set by microprocessor 54 and that is to be compared to the amplified microwave signal. It is to be understood that the ratio of the amplitude of the lower PIR sensor signal to the amplitude of the upper PIR sensor signal may be different for different detector assemblies. However, approximate values of the ratio as a function of distance can be developed that represent a best compromise for a particular detector assembly.

In operation, microprocessor 54 receives the upper PIR sensor signal via input 52 and the lower PIR sensor signal via input 72. Microprocessor 54 can then calculate or otherwise determine a relationship between the lower PIR sensor signal and the upper PIR sensor signal that is indicative of a distance between the detected source of infrared energy and housing 12. Because the desired level of the threshold voltage on output 98 depends upon the distance between the detected source of infrared energy and housing 12, microprocessor 54 can vary the threshold voltage in response to the relationship between the lower PIR sensor signal and the upper PIR sensor signal. In one embodiment, microprocessor 54 can vary the threshold voltage in response to a ratio between the amplitude of the lower PIR sensor signal and the amplitude of the upper PIR sensor signal.

FIG. 4 is a plot illustrating one embodiment of how microprocessor 54 may vary the threshold voltage in response to the ratio between the amplitude of the lower PIR sensor signal and the amplitude of the upper PIR sensor signal. For example, if microprocessor 54 calculates that the ratio between the amplitude of the lower PIR sensor signal and the amplitude of the upper PIR sensor signal is equal to one (indicative of the source of infrared energy being about seventeen feet from housing 12), microprocessor 54 can set the value of the threshold voltage on output 98 equal to $V_{TH\ medium}$. Microprocessor 54 can find the value of $V_{TH\ medium}$ in a lookup table that is stored in memory. Such a lookup table may match values of the ratio of the amplitude of the lower PIR sensor signal to the amplitude of the upper PIR sensor signal with corresponding threshold voltage values. Alternatively, microprocessor 54 can use an equation stored in memory that relates the amplitude ratio to the threshold value, i.e., defines the threshold value as a function of the amplitude ratio.

As another example from FIG. 4, if microprocessor 54 calculates that the ratio between the amplitude of the lower PIR sensor signal and the amplitude of the upper PIR sensor signal is equal to 0.01 (indicative of the source of infrared energy being over 23 feet (7.01 m) from housing 12 in the illustrated embodiment), microprocessor 54 can set the value of the threshold voltage on output 98 equal to $V_{TH\ long}$. As a final example, if microprocessor 54 calculates that the ratio between the amplitude of the lower PIR sensor signal and the amplitude of the upper PIR sensor signal is equal to 100 (indicative of the source of infrared energy being less than 5 feet from housing 12 in the illustrated embodiment), microprocessor 54 can set the value of the threshold voltage on output 98 equal to $V_{TH\ short}$. Of course, the exact relationship between the amplitude ratio and threshold voltage that is used by microprocessor 54 may be different than as shown.

The present invention takes advantage of the fact that the peak voltages of the microwave output signal increase as a human gets closer to the microwave transceiver, yet, for a pet, the peak voltages may actually decrease in closer proximity to the microwave transceiver. In the embodiment described above, the threshold voltage is increased as the human/pet gets closer to the microwave transceiver, thereby decreasing the chances of a false alarm caused by a pet while still detecting the presence of a human intruder.

In one embodiment, an alarm signal is generated not in response to the microwave output signal exceeding the threshold voltage in a single cycle, but rather in response to the microwave output signal exceeding the threshold voltage over a threshold number of times within a predetermined period of time. Because the microwave output signal may more resemble random noise than a stable signal having consistent peak voltages, it may be advantageous, in terms of avoiding false alarms, to generate an alarm signal only after a threshold voltage has been exceeded more than a threshold number of times within a certain time period.

It is also possible for the alarm signal to be generated in response to the microwave output signal exceeding the threshold voltage a predetermined number of times within a time period of duration less than a threshold time duration. Thus, it is possible to generate an alarm signal in response to some characteristic of the microwave output signal, other than the voltage, exceeding or falling below a threshold value. As described above, an alarm signal can be generated in response to the voltage of the microwave output signal exceeding a threshold value in excess of a threshold number of times within a predetermined time period. An alarm signal can also be generated in response to a voltage of the microwave output signal exceeding a threshold value a predetermined number of times in less than a threshold time period.

It is possible, within the scope of the invention, for some threshold value other than a threshold voltage value to be varied in response to a relationship between the lower PIR sensor signal and the upper PIR sensor signal. For example, microprocessor 54 can vary a threshold number of times the microwave output signal must exceed a threshold voltage value within a period of time before an alarm signal is generated. As another example, microprocessor 54 can vary a threshold time period within which the microwave output signal must exceed a threshold voltage value a predetermined number of times before an alarm signal is generated. Further, it is also possible for two or more of the above-described threshold values to be varied in response to a relationship between the lower PIR sensor signal and the upper PIR sensor signal.

The relationship between the lower PIR sensor signal and the upper PIR sensor signal discussed in the above embodiments may be the ratio of the amplitude of the lower PIR sensor signal to the amplitude of the upper PIR sensor signal, or some other relationship. For example, the relationship may be the ratio of the difference between the maximum voltage and the minimum voltage, i.e., the peak-to-peak voltage, in the lower PIR sensor signal to the difference between the maximum voltage and the minimum voltage in the upper PIR sensor signal. It is also possible to use a relationship between the current signals rather than the voltage signals of the lower PIR sensor and the upper PIR sensor when determining a level at which to set a threshold value.

Upper sensor 14 has been described herein as detecting infrared energy in two detection zones, a first of which intersects wall 24, and a second of which intersects both wall 24 and floor 26. However, it is to be understood that it is possible for the upper sensor to detect infrared energy in any number of detection zones, with any number of these detection zones intersecting either wall 24 or floor 26. Moreover, lower sensor 16 has been described herein as detecting infrared energy in four detection zones, all of which intersect floor 26. However, it is to be understood that it is possible for the lower sensor to detect infrared energy in any number of detection zones, with any number of these detection zones intersecting either wall 24 or floor 26.

The present invention has been described, for ease of illustration, as having two infrared detectors. However, it is to be understood that it is also possible, within the scope of the present invention, for the detection intrusion system to include more than two infrared detectors for monitoring respective spaces, with a threshold value being varied in response to a relationship between any combination of signals from the multiple infrared detectors. Further, it is possible for the detection intrusion system to include only a single infrared detector, perhaps monitoring only a lower detection zone or only an upper detection zone, with a threshold value being varied in response to object location information extracted from the signal from the infrared detector. For example, if only an upper PIR sensor were used having detection zones 28, 30, a pet would not be detected when it was relatively close to the detector because it would be located below detection zone 28. Only at more distant locations would the pet be detected by the upper PIR sensor. In this situation, the threshold voltage could be set at a relatively high value, $V_{TH\ short}$, when the upper PIR sensor did not detect the presence of a thermal energy source, e.g., FIG. 2*b*. When the presence of a thermal energy source, e.g., a human or pet, is detected iby the upper PIR sensor, the value of the threshold voltage could then be reduced, e.g., from $V_{TH\ medium}$ to $V_{TH\ long}$, as the value of the upper PIR sensor signal is reduced, e.g., from that shown in FIG. 2*c* to that shown in FIG. 2*d*.

The threshold values described herein may be a proxy for the more general concept of the sensitivity of the microwave transceiver. The scope of the present invention may include any embodiment in which the sensitivity of the system to the output of the microwave transceiver is modified based upon one or more signals from an infrared or near infrared sensor. In specific embodiments, the sensitivity of the system to the output of the microwave transceiver is decreased as the signal strength of the lower PIR sensor increases relative to the signal strength of the upper PIR sensor.

The present invention not only improves the false alarm immunity of pets, but also other non-human objects such as moving window blinds and insects crawling or flying close to the detector. The improvement provided by the present invention is particularly significant for false alarm sources that provide infrared energy that can be detected by a PIR sensor.

While this invention has been described as having an exemplary design, the present invention may be further modified within the spirit and scope of this disclosure. This application is therefore intended to cover any variations, uses, or adaptations of the invention using its general principles.

What is claimed is:

1. An intrusion detection system comprising:

a microwave transceiver configured to detect motion in a protected space, said microwave transceiver generating a first signal;

a first infrared sensor configured to detect a source of infrared energy in a plurality of upper detection zones within the protected space, said first infrared sensor generating an upper sensor signal;

a second infrared sensor configured to detect a source of infrared energy in a plurality of lower detection zones positioned below the upper detection zones within the protected space and intersecting a floor surface within the protected space, the second infrared sensor generating a lower sensor signal; and a processor configured to receive the first signal, the upper sensor signal and the lower sensor signal, said processor being configured to generate an alarm signal in response to the first signal exceeding a threshold value, the threshold value being varied in response to a relationship between the lower sensor signal and the upper sensor signal.

2. The system of claim 1 wherein infrared energy from the protected space is focused upon the first and second infrared sensors with substantially equivalent efficiency.

3. The system of claim 1 wherein gaps between adjacent ones of the detection zones all have maximum heights of less than about 3.5 feet.

4. The system of claim 1 wherein the threshold value is relatively increased in response to the lower sensor signal indicating the presence of a source of infrared energy and the upper sensor signal indicating the absence of a source of infrared energy.

5. The system of claim 1 wherein the relationship comprises a ratio between respective amplitudes of the lower sensor signal and the upper sensor signal.

6. The system of claim 1 wherein the threshold value comprises a threshold voltage value.

7. The system of claim 1 wherein the lower protection zones are adjacent a portion of the floor surface disposed approximately between 0 feet and 23 feet away from said second infrared sensor.

8. The system of claim 1 wherein at least one of the upper detection zones intersects a portion of the floor surface disposed approximately between 23 feet and 40 feet away from said first infrared sensor.

9. The system of claim 1 further comprising a housing containing each of said microwave transceiver, said first infrared sensor and said second infrared sensor.

10. An intrusion detection system comprising:

a microwave transceiver configured to detect motion in a protected space, said microwave transceiver generating a first signal;

a first infrared sensor configured to detect a source of infrared energy in a plurality of upper detection zones within the protected space, said first infrared sensor generating an upper sensor signal;

a second infrared sensor configured to detect a source of infrared energy in a plurality of lower detection zones positioned below the upper detection zones within the protected space, the second infrared sensor generating a lower sensor signal; and a processor configured to receive the first signal, the upper sensor signal and the lower sensor signal, said processor being configured to generate an alarm signal in response to the first signal crossing a threshold value a required number of times within a time period, at least one of the required number and the time period being varied in response to a relationship between the lower sensor signal and the upper sensor signal.

11. The system of claim 10 wherein the lower protection zones are adjacent a first portion of the floor surface disposed approximately between 0 feet and 23 feet away from said second infrared sensor, and at least one of the upper detection zones intersects a second portion of the floor surface disposed approximately between 23 feet and 40 feet away from said first infrared sensor.

12. The system of claim 10 wherein infrared energy from the protected space is focused upon the first and second infrared sensors with substantially equivalent efficiency.

13. The system of claim 10 wherein the required number varies with a ratio between an amplitude of the lower sensor signal and an amplitude of the upper sensor signal.

14. The system of claim 10 wherein the time period varies inversely with a ratio between an amplitude of the lower sensor signal and an amplitude of the upper sensor signal.

15. The system of claim 10 wherein gaps between adjacent ones of the detection zones all have maximum heights of less than about 3.5 feet.

16. The system of claim 10 wherein the relationship comprises a ratio between respective amplitudes of the lower sensor signal and the upper sensor signal.

17. An intrusion detection system comprising:

a microwave transceiver configured to detect motion in a protected space, said microwave transceiver generating a first signal having a characteristic;

a first infrared sensor configured to detect a source of infrared energy in a plurality of upper detection zones within the protected space, said first infrared sensor generating an upper sensor signal;

a second infrared sensor configured to detect a source of infrared energy in a plurality of lower detection zones positioned below the upper detection zones within the protected space, the second infrared sensor generating a lower sensor signal; and a processor configured to receive the first signal, the upper sensor signal and the lower sensor signal, said processor being configured to generate an alarm signal in response to the characteristic of the first signal exceeding a threshold value, the threshold value varying in response to a relationship between the lower sensor signal and the upper sensor signal.

18. The system of claim 17 wherein the lower detection zones are disposed adjacent a first portion of the floor surface disposed approximately between 0 feet and 23 feet away from said second infrared sensor, and at least one of the upper detection zones intersects a second portion of the floor surface disposed approximately between 23 feet and 40 feet away from said first infrared sensor.

19. The system of claim 17 wherein infrared energy from the protected space is focused upon the first and second infrared sensors with substantially equivalent efficiency.

20. The system of claim 17 wherein the characteristic of the first signal comprises a voltage.

21. The system of claim 17 wherein the characteristic of the first signal comprises a number of times a voltage of the first signal crosses a voltage level.

22. The system of claim 17 wherein the relationship comprises a ratio between an amplitude of the lower sensor signal and an amplitude of the upper sensor signal.

23. An intrusion detection system comprising:

a microwave transceiver configured to detect motion in a protected space, said microwave transceiver generating a first signal;

a first infrared sensor configured to detect a source of infrared energy in a plurality of upper detection zones within the protected space, said first infrared sensor generating an upper sensor signal; and a processor configured to receive the first signal and the upper sensor signal and generate an alarm signal when the first signal exceeds a variable threshold value wherein said variable threshold value has a maximum value when said upper sensor signal indicates the absence of the infrared energy source in said upper detection zones and, when said upper sensor signal indicates the presence of infrared energy source in said upper detection zone, said variable threshold value is decreased as said upper sensor signal decreases.

24. The system of claim 23 wherein the upper detection zones intersect a floor surface no closer than approximately 23 feet from some said first infrared sensor.

25. The system of claim 23 further comprising a second infrared sensor configured to detect a source of infrared energy in a plurality of lower detection zones positioned below the upper detection zones within the protected space and intersecting a floor surface within the protected space.

* * * * *